US007481422B2

(12) United States Patent
Lim

(10) Patent No.: US 7,481,422 B2
(45) Date of Patent: Jan. 27, 2009

(54) PAPER PICKUP UNIT AND IMAGE FORMING APPARATUS HAVING THE SAME

(75) Inventor: Kwang-Taek Lim, Gwangmyung-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 455 days.

(21) Appl. No.: 11/237,730

(22) Filed: Sep. 29, 2005

(65) Prior Publication Data

US 2006/0070536 A1 Apr. 6, 2006

(30) Foreign Application Priority Data

Oct. 2, 2004 (KR) ..... 10-2004-0078539

(51) Int. Cl.
*B65H 3/06* (2006.01)

(52) U.S. Cl. ..... 271/118; 271/117; 271/109; 271/126; 271/127

(58) Field of Classification Search ..... 271/127, 271/266, 106, 113, 114, 119, 118, 117, 157, 271/109
See application file for complete search history.

(56) References Cited

U.S. PATENT DOCUMENTS

| | | | | |
|---|---|---|---|---|
| 4,339,196 | A | 7/1982 | Beck et al. | |
| 4,717,139 | A * | 1/1988 | Sootome et al. | 271/116 |
| 4,905,984 | A * | 3/1990 | Haigh | 271/270 |
| 5,181,712 | A * | 1/1993 | Perino | 271/109 |
| 5,201,873 | A * | 4/1993 | Kikuchi et al. | 271/9.13 |
| 5,253,854 | A * | 10/1993 | Tanoue et al. | 271/10.12 |
| 5,358,230 | A * | 10/1994 | Ikemori et al. | 271/114 |
| 5,449,161 | A * | 9/1995 | Gysling | 271/119 |
| 5,895,038 | A * | 4/1999 | Takashima | 271/114 |
| 5,984,297 | A * | 11/1999 | Tanaka | 271/118 |
| 6,059,282 | A * | 5/2000 | Jang | 271/160 |
| 6,070,867 | A * | 6/2000 | Tsurumi et al. | 271/114 |
| 2005/0140081 | A1 * | 6/2005 | Sugimura et al. | 271/118 |

FOREIGN PATENT DOCUMENTS

| | | | |
|---|---|---|---|
| JP | 61-192641 | | 8/1986 |
| JP | 61226424 | * | 10/1986 |
| JP | 61226424 A | * | 10/1986 |

(Continued)

OTHER PUBLICATIONS

Korean Office Action dated Aug. 29, 2007 issued in KR 2004-78539.

*Primary Examiner*—Patrick H Mackey
*Assistant Examiner*—Patrick D Cicchino
(74) *Attorney, Agent, or Firm*—Stanzione & Kim, LLP

(57) ABSTRACT

An image forming apparatus having a paper pickup unit includes a power unit to drive a shaft of the paper pickup unit, wherein the paper pickup unit includes a pressing plate at which a recording medium, such as a sheet of paper, is stacked, a paper feed unit body to receive the pressing plate, a shaft rotatably mounted on a front end of the pressing plate, a pickup roller to rotatably engage the shaft to pick up the recording medium stacked on the pressing plate, and a guide cam installed at least one side of the shaft and having a shock absorbing part engaged with a guide part installed at the paper feed unit body.

30 Claims, 7 Drawing Sheets

FOREIGN PATENT DOCUMENTS

| | | | |
|---|---|---|---|
| JP | 04-169471 | | 6/1992 |
| JP | 08-225167 | | 9/1996 |
| JP | 08225167 | * | 9/1996 |
| JP | 08225167 A | * | 9/1996 |
| JP | 2003-182862 | | 7/2003 |

* cited by examiner

PAPER PICKUP UNIT AND IMAGE FORMING APPARATUS HAVING THE SAME

CROSS-REFERENCE TO RELATED APPLICATIONS

This application claims the benefit of Korean Patent Application No. 2004-78539 filed Oct. 2, 2004, the disclosure of which is hereby incorporated herein by reference in its entirety.

BACKGROUND OF THE INVENTION

1. Field of the Invention

The present general inventive concept relates to a paper pickup unit and an image forming apparatus having the same, and more particularly, to a paper pickup unit to reduce noises due to an impact between a pressing plate and a pickup roller of a main body of a paper feed unit when paper is picked up from the main body of the paper feed unit, and an image forming apparatus having the same.

2. Description of the Related Art

In general, an image forming apparatus includes a paper feed unit body for feeding a recording medium, such as a paper, at which an image is to be formed, an image forming part for forming the image on the recording medium supplied from the paper feed unit body, and a paper discharge part for discharging the recording medium, at which the image has been formed, from the image forming part.

In addition, a paper pickup unit is installed to supply the recording medium stacked on the paper feed unit body to the image forming part.

FIG. 1 illustrates a driving state of a conventional paper pickup unit 200 of an image forming apparatus.

Referring to FIG. 1, the conventional paper pickup unit 200 is installed in the image forming apparatus, which includes a shaft 201 having a pickup roller 230 for picking up a recording medium (not shown) such as a paper stacked on a pressing plate of a paper feed unit body 100, and a guide cam 210 fixedly installed at both ends of the shaft 201 to be in contact with a guide part 110 of the paper feed unit body 100.

The guide part 110 is installed on the paper feed unit body 100 and includes a guide roller 111 rotated in contact with a portion of a surface of the guide cam 210, and a guide roller housing 112 for supporting the guide roller 111.

Hereinafter, an operation of the conventional paper pickup unit 200 will be described.

When a predetermined image forming order is transmitted from a controller (not shown) in a state that the paper feed unit body 100, at which a number of sheets of paper are stacked on a pressing plate 101, is mounted on the image forming apparatus, the shaft 201 is rotated in a direction A by a driving force of a power unit 145 together with a rotation of the guide cams 210 at both ends of the shaft 201, at this time the guide roller 111 of the paper feed unit body 100 is rotated in contact with a portion of the surface of the guide cam 210 to guide a lift operation of the paper feed unit body 100 pressed upward by a compression spring 120 installed under the pressing plate 101.

In addition, the sheets stacked on the pressing plate 101 of the paper feed unit body 100 is in contact with the pickup roller 230 of the shaft 201 to rotate the pickup roller 230, thereby supplying the sheets to the image forming part (not shown) one by one.

However, when a last sheet of the paper stacked on the paper feed unit body 100 remains, a stack height of the sheets on the pressing plate is lowered, the paper feed unit body 100 is lifted by the compression spring 120, and the guide cam 210 in contact with the guide roller 111 of the paper feed unit body 100 is rotated in the direction A, as a result, the guide roller 111 is located at a lower end of the guide cam 210.

At this time, one end of a pickup housing 231 for supporting both side surfaces of the pickup roller 230 mounted on the shaft 201 collides with a portion of a surface of the lifted pressing plate 101 of the paper feed unit body 100 to generate impact noises.

In addition, when a small number of recording media are stacked on the paper feed unit body 100, the remaining small number of recording media become deviated from a conveying position of the pressing plate 101, thereby causing a paper jam or a skew phenomenon.

SUMMARY OF THE INVENTION

The present general inventive concept provides a paper pickup unit capable of preventing noise from generating due to an impact between a pressing plate of a paper feed unit body and a pickup housing of a pickup roller even when a small number of recording media are stacked, by forming a guide cam in contact with a guide roller of the paper feed unit body in a cantilever shape to absorb a pressing force of the paper feed unit body lifted by a compression spring, thereby allowing the cantilever-shaped cam to be guided in contact with the guide roller, and an image forming apparatus having the same.

Additional aspect and advantages of the present general inventive concept will be set forth in part in the description which follows and, in part, will be obvious from the description, or may be learned by practice of the invention.

The foregoing and/or other aspects and advantages of the present general inventive concept may be achieved by providing a paper pickup unit including a pressing plate, at which one or more recording media are stacked, a paper feed unit body to receive the pressing plate, a shaft rotatably mounted on a front end of the pressing plate, a pickup roller to rotatably engage the shaft to pick up each of the recording media stacked on the pressing plate, and a guide cam installed at least one side of the shaft and having a shock absorbing part engaged with a guide part installed at the paper feed unit body.

The shock absorbing part may be made of a resilient material to absorb an impact as the absorbing part is deformed by the pressing plate.

The shock absorbing part may have a cantilever shape.

The shock absorbing part may further include a shock absorbing pad.

The foregoing and/or other aspects and advantages of the present inventive concept may also be achieved by providing an image forming apparatus having a paper pickup unit which includes a power unit, such as a motor, to drive a shaft, wherein the paper pickup unit includes a pressing plate, at which one or more recording media are stacked, a paper feed unit body to receive the pressing plate, a shaft rotatably mounted on a front end of the pressing plate, a pickup roller to rotatably engage the shaft to pick up each of the recording media stacked on the pressing plate, a guide cam installed at least one side of the shaft and having a shock absorbing part engaged with a guide part installed at the paper feed unit body.

The guide part may include a guide roller to guide the guide cam to rotate, and a guide roller housing installed in the paper feed unit body to rotatably support the guide roller.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
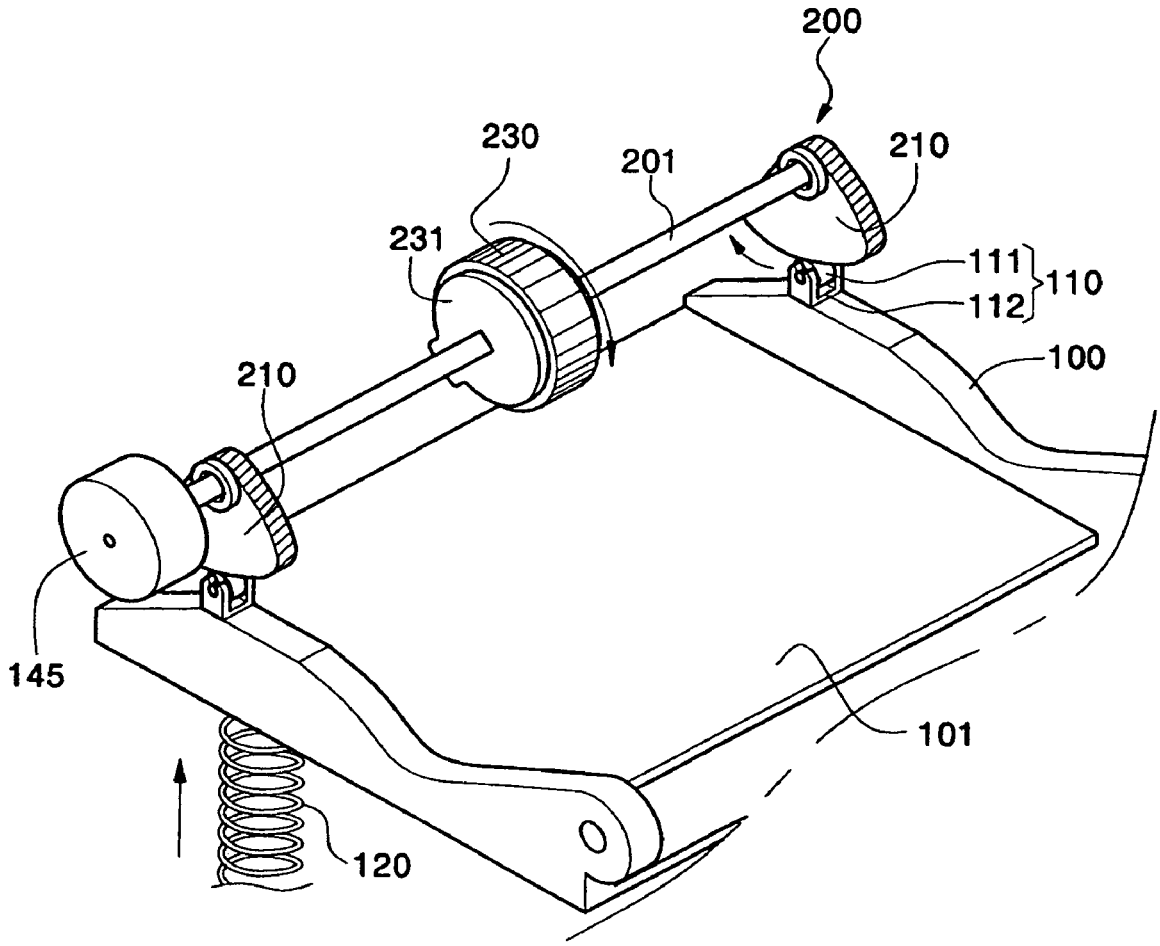
FIG. 1 (PRIOR ART)
FIG. 1 is a perspective view partially illustrating a conventional paper feed unit.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Hereinafter, exemplary embodiments in accordance with the present invention will be described in conjunction with the accompanying drawings.

FIGS. 2 to 5B illustrate an image forming apparatus having a paper pick up unit 300 according to an embodiment of the present general inventive concept.

Figure 2:
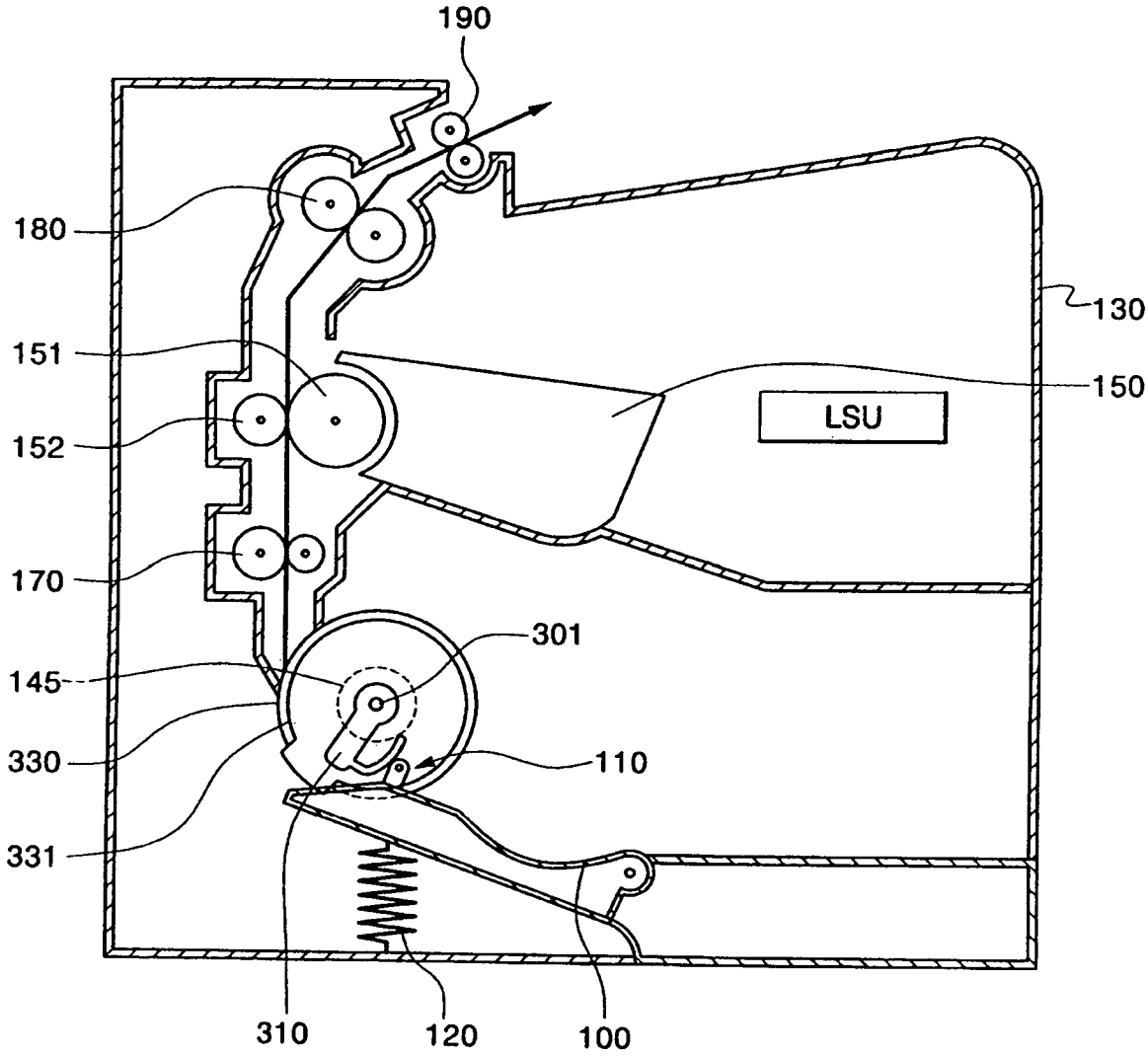
FIG. 2 is a cross-sectional view illustrating an image forming apparatus having a paper pickup unit according to an embodiment of the present general inventive concept.

Referring to FIG. 2, the paper pickup unit 300 is mounted on the image forming apparatus including a main body 130, a paper feed unit body 100 detachably installed at the main body 130 to stack a recording medium such as a sheet of paper, a photosensitive drum 151 of a developer 150 to form an image transmitted from a controller on the recording medium fed from the paper feed unit body 100, an exposing unit LSU to expose the photosensitive drum 151 to light to form a latent image on the photosensitive drum 150, a feed roller 170 to guide the recording medium to a transfer roller 152, a setting roller 180 to set the image formed on the recording medium through the transfer roller 152, and a paper discharge roller 190 to discharge the recording medium, at which the image is formed through the setting roller 180.

Figure 3:
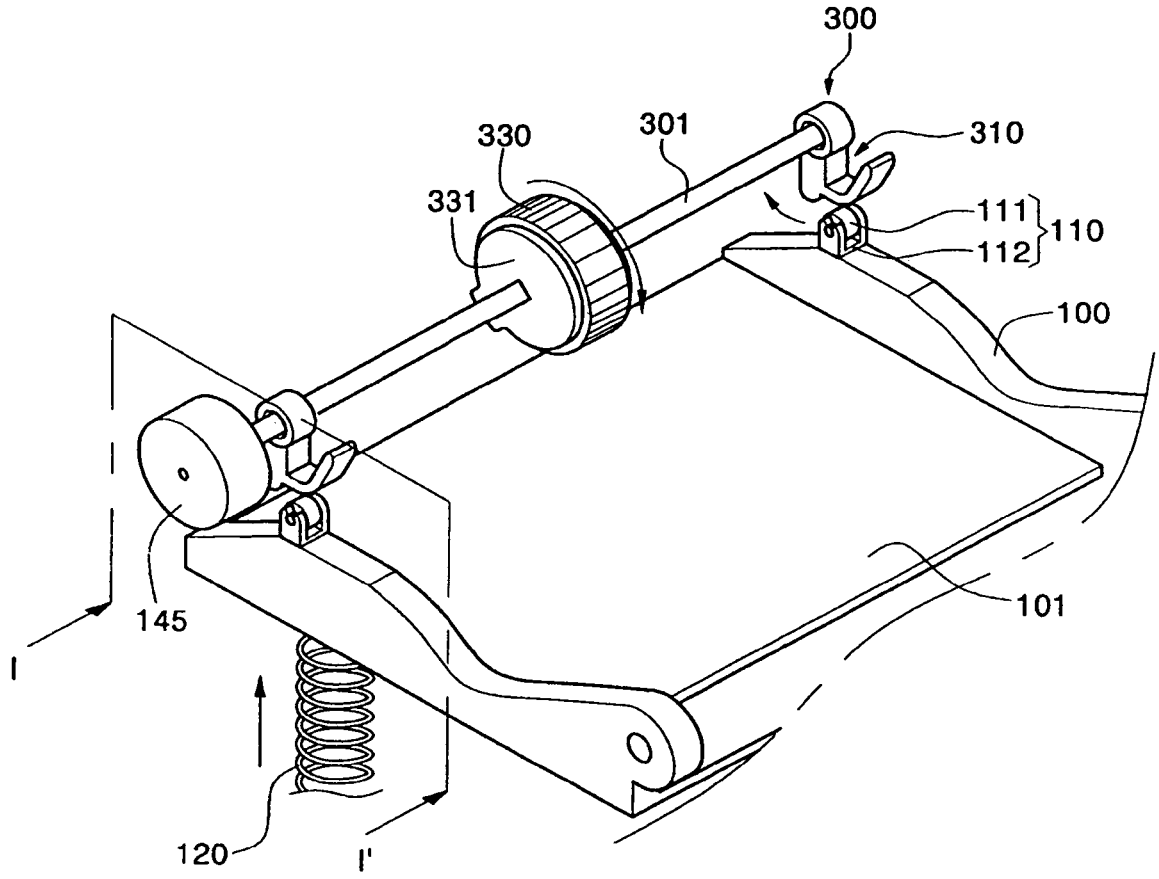
FIG. 3 is a perspective view partially illustrating the paper pickup unit of FIG. 2.

Referring to FIG. 2 and 3, the image forming apparatus according to the present general inventive concept includes a pressing plate 101 to stack a recording medium, such as a sheet of paper, a paper feed unit body 100 to receive the pressing plate 101, a shaft 301 rotatably mounted on a front end of the pressing plate 101, a pickup roller 330 to rotatably engage the shaft 301 to pick up the recording medium stacked on the pressing plate 101, a guide cam 310 installed at least one side of the shaft 301 and having shock absorbing parts 311*a* and 321*a* engaged with a guide part 110 installed at the paper feed unit body 100, and a power unit 145, such as a motor, connected to the shaft 301 to rotate the shaft 301.

Here, the guide part 110 includes a guide roller 111 to guide the guide cam 310 to rotate, and a guide roller housing 112 installed in the paper feed unit body 100 to rotatably support the guide roller 111.

Referring to FIG. 3, the paper pickup unit 300 includes the shaft 301 installed in the main body 130 and above the paper feed unit body 100 to be rotated by a driving force of the power unit 145, a pickup roller 330 installed on the shaft 301 through a pick up housing 331 at its both side to pick up the recording medium stacked on the pressing plate 101 of the paper feed unit body 100 by rotating in contact with one surface of the recording medium, and the guide cam 310 installed at the shaft 301 to guide in contact with the guide part 110 installed at the paper feed unit body 100 and having a cantilever-shaped shock absorbing part 311*a* installed to absorb a pressing force of the paper feed unit body 100 pressed upward by a compression spring 120.

In this connection, the guide part 110 includes a guide roller 111 rotated in contact with a surface of the shock absorbing part 311*a* of the guide cam 310, and a guide roller housing 112 installed in the paper feed unit body 100 to rotatably support the guide roller 111.

Figure 4:
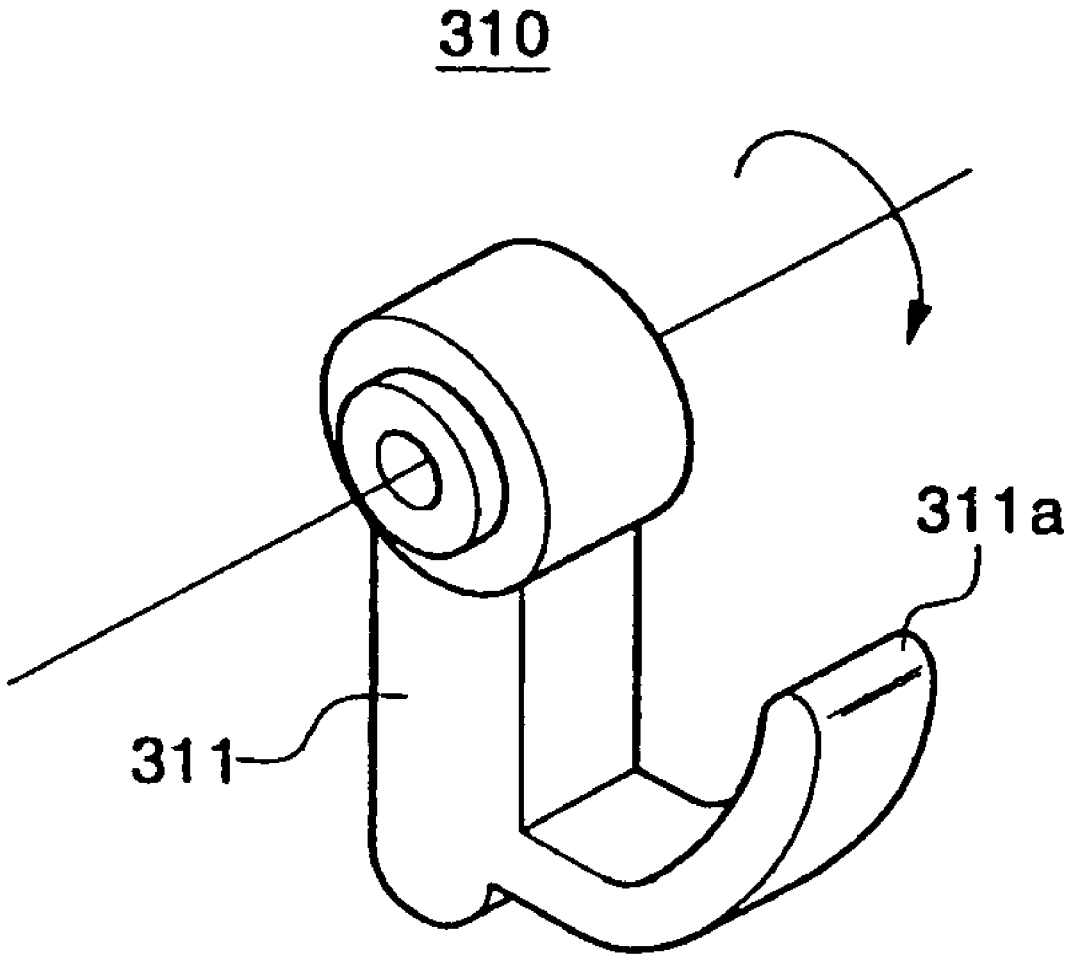
FIG. 4 is a perspective view illustrating a guide cam shown in FIG. 3.

Referring to FIG. 4, the guide cam 310 has the cantilever-shaped shock absorbing part 311*a* bent at one side of a guide cam body 311, which is bent in a "U"-shape to form a groove shape with the absorbing part 311*a*.

Figure 5A:
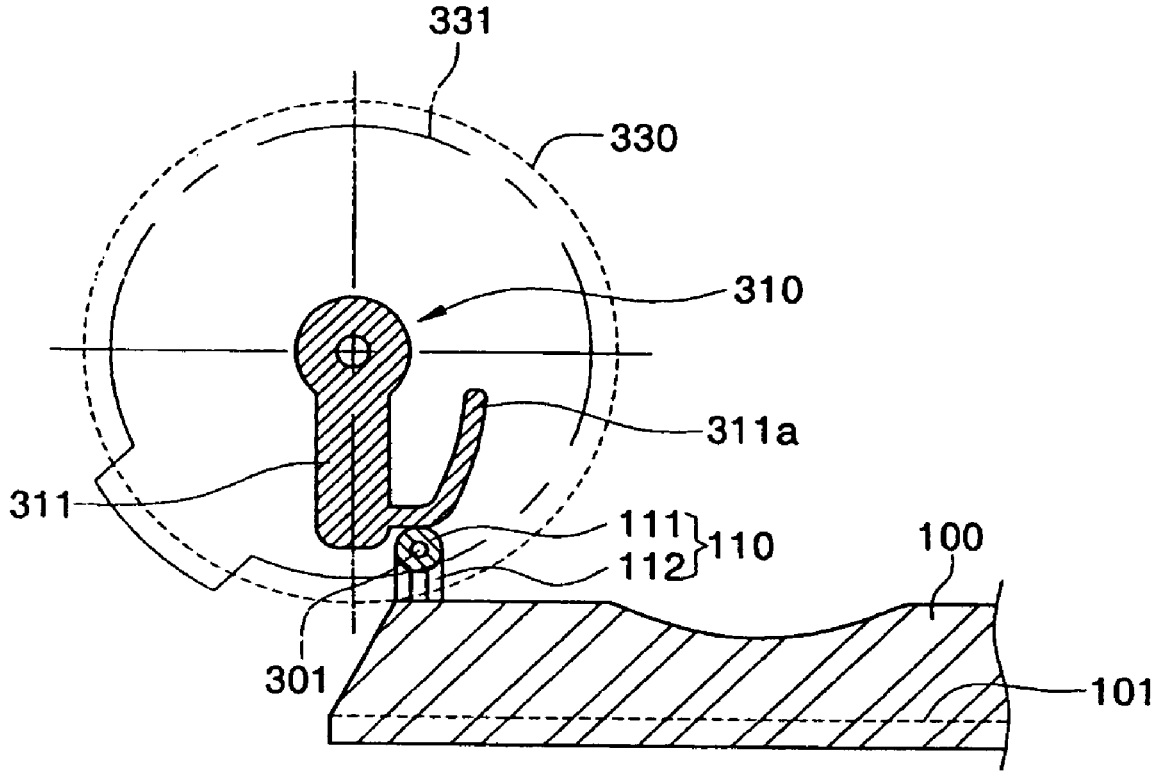
FIG. 5A is a cross-sectional view taken along a line I-I' shown in FIG. 3.

FIG. 5A is a view taken along a line I-I' of FIG. 3 to illustrate a state of the paper pickup unit 300 before the guide cam 310 is rotated.

Referring to FIG. 5A, the guide roller 110 of the paper feed unit body 100 is in contact with a lower surface of the shock absorbing part 311*a* of the guide cam 310, and the recording medium stacked on the pressing plate 101 is in contact with the pickup roller 330.

At this time, in a process of continuously performing an image forming operation on recording media stacked on the paper feed unit body 100, the shaft 301 is rotated by the power unit 145 to continuously feed the recording medium in contact with the pickup roller 330 toward the feed roller 170.

Figure 5B:
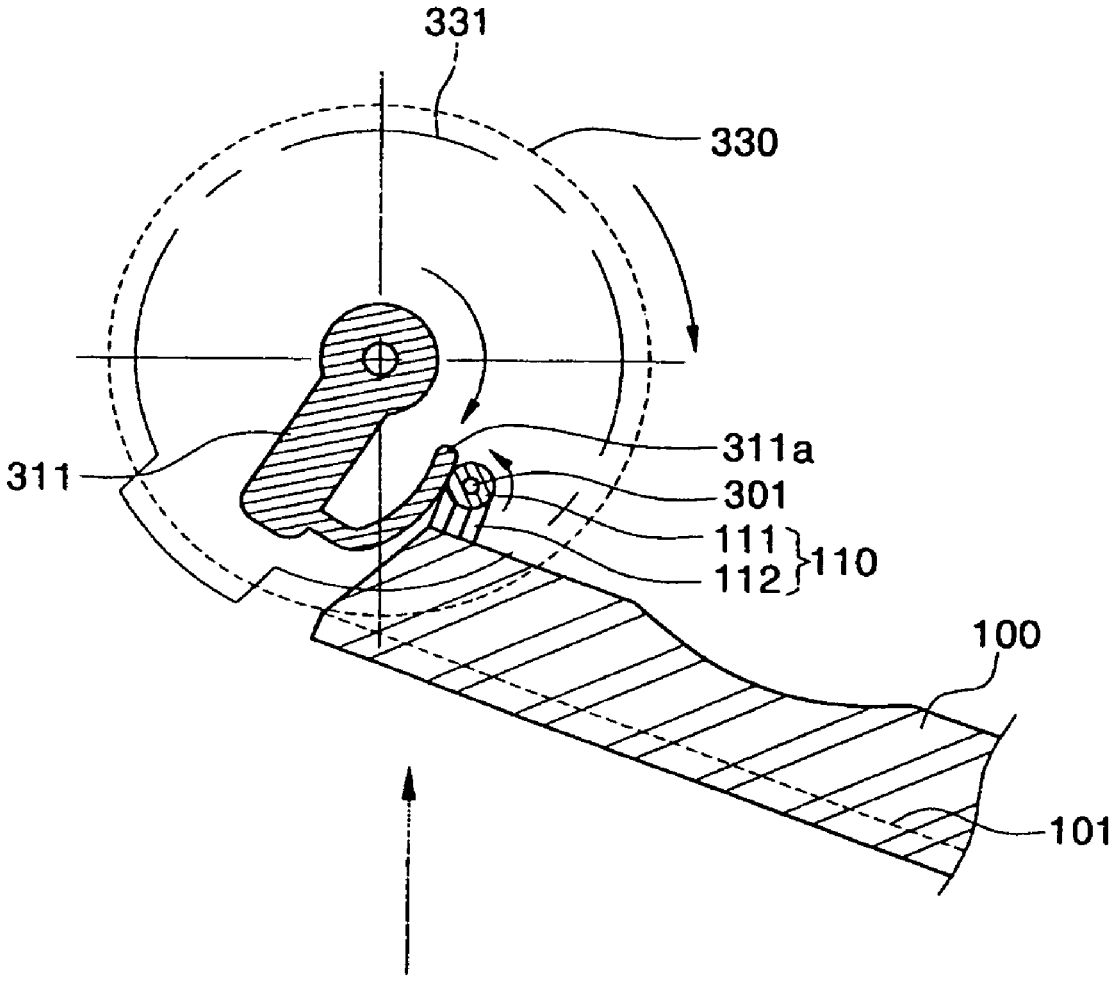
FIG. 5B is a cross-sectional view illustrating an operation of the guide cam shown in FIG. 4.

Referring to FIG. 5B, in the process of performing the image forming operation, the amount (number) of the recording media stacked on the paper feed unit body 100 is reduced to lift up the pressing plate 101 due to the pressing force of the compression spring 120, and the guide cam 310 in contact with the guide roller 111 is rotated in a direction of an arrow B to make one end of the shock absorbing part 311*a* be in contact with the guide roller 111.

At this time, the cantilever-shaped shock absorbing part 311*a* in contact with the guide roller 111 absorbs the pressing force generated due to the lift of the pressing plate 101, the inwardly bent cantilever of which forms a groove shape with the guide cam body 311 to have a resilient force corresponding to the pressing force from the compression spring 120.

Therefore, the pressing force applied from the compression spring 120 installed under the pressing plate 101 may be absorbed.

Of course, the cantilever-shaped shock absorbing part 311*a* formed at the guide cam body 311 should be designed to have the resilient force larger than that of the compression spring 120. That is, a thickness and a length of the cantilever-shaped shock absorbing part 311*a* should be considered depending on the pressing force of the compression spring 120.

Therefore, the guide cam 310 designed as described above is rotated in contact with the guide roller 111 of the paper feed unit body 100 being lifted, and the pressing force from the guide roller 111 is absorbed through the shock absorbing part

311*a* of the guide cam 310 installed in contact with the guide roller 111. As a result, even when a sheet of recording medium (or a small number of recording media) is stacked on the pressing plate 101, it may prevent the pressing plate 101 from directly colliding with the pickup housing 331 of the pickup roller 330 installed at the shaft 301 to thereby reduce the noise due to the impact.

Therefore, although the number of the recording media stacked on the paper feed unit body 100 is reduced as the image forming operation is performed, the noise generation may be prevented.

In addition, since the pressing force of the pressing plate 101 is absorbed by the shock absorbing part 311*a* of the guide cam 310, even when only one sheet of recording medium is stacked on the pressing plate 101 lifted by the compression spring 120, the recording medium and the pickup roller 330 do not directly collide with each other to prevent the recording medium from being deviated, thereby preventing a paper jam or a skew phenomenon.

Figure 6:
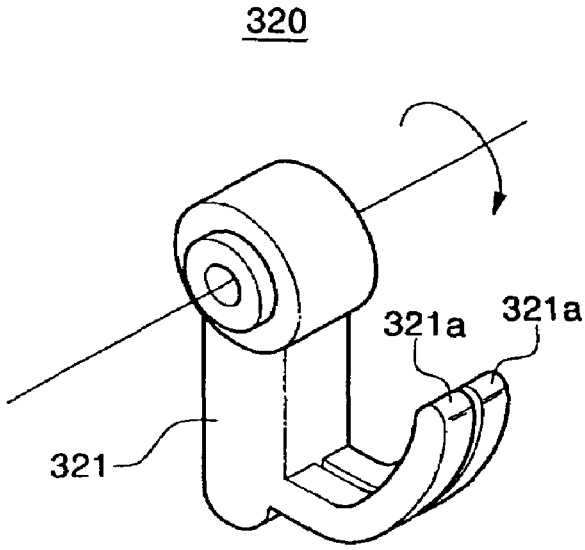
FIG. 6 is a perspective view illustrating a paper pickup unit according to an embodiment of the present general inventive concept.

FIG. 6 illustrates a paper pickup unit used with an image forming apparatus according to an embodiment of the present general inventive concept.

Referring to FIGS. 3 and 6, a guide cam 320 may have at least two cantilever-shaped shock absorbing parts 321*a* formed at a guide cam body 321.

The number of the shock absorbing parts 321*a* formed at the guide cam body 321 may be determined on the basis of a width of the guide roller 111 in contact with the shock absorbing parts 321*a*, and the thickness and length of the shock absorbing parts 321*a* should be designed to withstand the pressing force of the compression spring 120 installed under the pressing plate 101.

When the guide cam body 321 has a plurality of shock absorbing parts 321*a* as described above, the pressing force of the pressing plate 101 lifted by the compression spring 120 may be effectively distributed through the plurality of shock absorbing parts 321*a* in contact with the guide roller 111.

Figure 7:
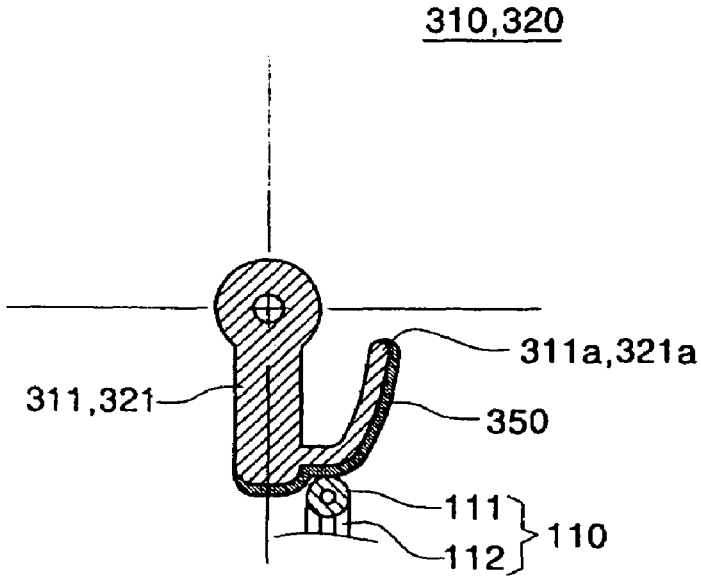
FIG. 7 is a cross-sectional view illustrating a paper pickup unit according to an embodiment of the present general inventive concept.

FIG. 7 illustrates a paper pickup unit used with an image forming apparatus according to an embodiment of the present general inventive concept.

Referring to FIGS. 3, 6, and 7, a resilient pad 350 having an arbitrary thickness is additionally attached to an outer surface of the shock absorbing part 311*a* formed at the guide cam body 311 of FIG. 3 to absorb a shock occurring between absorbing part 311*a* and the guide roller 111.

In addition, the resilient pad 350 may be additionally installed at outer surfaces of the plurality of shock absorbing parts 321*a* formed at the guide cam body 321 of FIG. 6.

Therefore, when the pressing plate 101 is lifted, the guide roller 111 installed at both sides of the pressing plate 101 is in contact with the resilient pad 350 attached to the outer surfaces of the shock absorbing parts 311*a* and 321*a* other than in direct contact with the shock absorbing parts 311*a* and 321*a*, thereby primarily absorbing the pressing force of the lifted pressing plate 101 through the resilient pad 350, and secondarily absorbing through the cantilever-shaped shock absorbing parts 311*a* and 321*a* to prevent the recording medium stacked on the pressing plate 101 from directly colliding with the pickup housing 331 of the pickup roller 330, As a result, the noise may be effectively reduced.

As can be seen from the foregoing, the paper pickup unit and the image forming apparatus having the same according to embodiments of the present general inventive concept has an advantage of absorbing the pressing force through the shock absorbing part of the guide cam, when the pressing plate is lifted up by the compression spring, by forming at least one cantilever-shaped shock absorbing part at the guide cam of the paper pickup unit to guide the lift operation of the paper feed unit body in contact with the guide roller of the paper feed unit body to make the shock absorbing part be in contact with the guide roller.

In addition, since a force of impacting the pickup roller of the paper pickup unit to the pressing plate may be reduced, the noise may also be effectively reduced when the amount (number) of the stacked recording media is small.

Further, when the small amount (number) of the recording media is stacked on the pressing plate, it is possible to prevent the paper jam or skew phenomenon due to deviation of the recording medium on the pressing plate.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A paper pickup unit comprising:

a pressing plate at which one or more recording media are stacked;

a paper feed unit body to receive the pressing plate, and having a guide part;

a shaft rotatably mounted on a front end of the pressing plate;

a pickup roller coupled to the shaft to pick up the recording medium stacked on the pressing plate; and a guide cam installed at least one side of the shaft and having a shock absorbing part to engage the guide part installed at the paper feed unit body, the guide cam having a first cam portion coupled to the shaft and a second cam portion extended from the first cam portion in a first direction of the shaft, and the shock absorbing part is extended from the second cam portion of the guide cam in a second direction.

2. The paper pickup unit according to claim 1, wherein the shock absorbing part is made of a resilient material and has a cantilever shape to be deformed by the guide part of the pressing plate so as to absorb an impact between the absorbing part and the pressing plate.

3. The paper pickup unit according to claim 1, wherein the shock absorbing part comprises a shock absorbing pad made of a resilient material.

4. The paper pickup unit according to claim 1, wherein the guide part comprises a guide roller to guide a rotation of the guide cam, and a guide roller housing installed in the paper feed unit body to rotatably support the guide roller.

5. The paper pickup unit according to claim 1, wherein the guide part comprises a guide roller and a guide roller housing installed in the paper feed unit body to rotatably support the guide roller, and the shock absorbing part elastically contacts the guide roller so as to reduce an impact between the guide part and the guide cam when the number of the one or more recording media stacked on the pressing plate is decreased.

6. The paper pickup unit according to claim 1, wherein the guide part comprises a guide roller and a guide roller housing formed on the pressing plate of the paper feed unit body to rotatably support the guide roller, and the shock absorbing part is deformed when contacting the guide roller, so as to absorb a shock between the guide part and the guide cam when the pressing plate moves toward the pickup roller.

7. A paper pickup unit comprising:

a pressing elate at which one or more recording media are stacked;

a paper feed unit body to receive the pressing plate, and having a guide part;

a shaft rotatably mounted on a front end of the pressing plate;

a pickup roller coupled to the shaft to pick up the recording medium stacked on the pressing plate; and a guide cam installed at least one side of the shaft and having a shock absorbing part to engage the guide part installed at the paper feed unit body, the guide cam having a first cam portion rotatably coupled to the shaft and a second cam portion extended from the first cam portion in a first direction of the shaft, and the shock absorbing part comprises at least two absorbing portions extended from the second cam portion in a second direction and disposed parallel to each other.

8. The paper pickup unit according to claim 7, wherein the at least two absorbing portions are spaced-apart from each other by a predetermined distance in a direction parallel to a rotation axis of the shaft.

9. The paper pickup unit according to claim 7, wherein one of the first and second cam portions of the guide cam has a length in a direction parallel to a rotation axis of the shaft longer than a sum of lengths of the at least two absorbing portions in the direction.

10. The paper pickup unit according to claim 7, wherein the at least two absorbing portions comprise at least two shock absorbing resilient pads attached thereto, respectively, to resiliently contact the guide part.

11. The paper pickup unit according to claim 7, wherein the at least two shock absorbing resilient pads are extended to cover a surface of the second cam portion which faces the guide part so that the surface of the second cam portion is prevented from contacting the guide part.

12. The paper pickup unit according to claim 1, wherein the shock absorbing part elastically moves with respect to the guide cam when the guide part moves toward the guide cam to contact the shock absorbing part.

13. A paper pickup unit comprising:

a pressing plate at which one or more recording media are stacked;

a paper feed unit body to receive the pressing plate, and having a guide part;

a shaft rotatably mounted on a front end of the pressing plate;

a pickup roller coupled to the shaft to pick up the recording medium stacked on the pressing plate; and a guide cam installed at least one side of the shaft and having a shock absorbing part to engage the guide part installed at the paper feed unit body, wherein the guide cam is extended from the shaft in a first direction, and the shock absorbing part is extended in a second direction to move with respect to the guide cam to absorb a shock occurring when the guide part is in contact with the shock absorbing part.

14. The paper pickup unit according to claim 1, wherein the guide cam and the shock absorbing part are formed in a single monolithic body.

15. The paper pickup unit according to claim 1, wherein the guide cam and the shock absorbing part form a groove therebetween.

16. A paper pickup unit comprising:

a pressing plate at which one or more recording media are stacked;

a paper feed unit body to receive the pressing plate, and having a guide part;

a shaft rotatably mounted on a front end of the pressing plate;

a pickup roller coupled to the shaft to pick up the recording medium stacked on the pressing plate; and a guide cam installed at least one side of the shaft and having a shock absorbing part to engage the guide part installed at the paper feed unit body, wherein the shock absorbing part comprises a distal end spaced apart from the shaft by a distance, and the distance varies according to a movement of the pressing plate with respect to the shaft while the guide cam and the shock absorbing part rotate with respect to a rotation axis of the shaft.

17. The paper pickup unit according to claim 1, wherein the paper feed unit body comprises an elastic element to generate a pressing force to move the pressing plate toward the paper pickup unit, and the shock absorbing part has an elastic force greater than the pressing force of the elastic element.

18. An image forming apparatus comprising:

a paper pickup unit including, a pressing plate at which a recording medium is stacked, a paper feed unit body to receive the pressing plate and having a guide part, a shaft rotatably mounted on a front end of the pressing plate, a pickup roller to rotatably engage the shaft to pick up the recording medium stacked on the pressing plate, and a guide cam installed at least one side of the shaft and having a shock absorbing part to engage the guide part installed at the paper feed unit body, the guide cam having a first cam portion coupled to the shaft and a second cam portion extended from the first cam portion in a first direction of the shaft, and the shock absorbing part is extended from the second cam portion in a second direction; and a power unit to drive the shaft of the paper pickup unit.

19. The image forming apparatus according to claim 18, wherein the shock absorbing part is made of a resilient material and has a cantilever shape to absorb an impact as the absorbing part is deformed by the pressing plate.

20. The image forming apparatus according to claim 18, wherein the shock absorbing part further comprises a shock absorbing pad made of a resilient material.

21. The image forming apparatus according to claim 18, wherein the guide part comprises a guide roller guide a rotation of the guide cam, and a guide roller housing installed in the paper feed unit body to rotatably support the guide roller.

22. The image forming apparatus according to claim 18, wherein the guide part comprises a guide roller and a guide roller housing installed in the paper feed unit body to rotatably support the guide roller, and the shock absorbing part elastically contacts the guide roller so as to reduce an impact between the guide part and the guide cam when the number of the one or more recording media stacked on the pressing plate is decreased.

23. The image forming apparatus according to claim 18, wherein the guide part comprises a guide roller and a guide roller housing formed on the pressing plate of the paper feed unit body to rotatably support the guide roller, and the shock absorbing part elastically moves when contacting the guide roller, so as to reduce an impact between the guide part and the guide cam when the pressing plate moves toward the pickup roller.

24. An image forming apparatus comprising:

a paper pickup unit including, a pressing plate at which a recording medium is stacked, a paper feed unit body to receive the pressing plate and having a guide part, a shaft rotatably mounted on a front end of the pressing plate, a pickup roller to rotatably engage the shaft to pick up the recording medium stacked on the pressing plate, and a guide cam installed at least one side of the shaft and having a shock absorbing part to engage the guide part installed at the paper feed unit body, the guide cam having a first cam portion rotatably coupled to the shaft and a second cam portion extended from the first cam portion in a first direction of the shaft, and the shock absorbing part comprises at least two absorbing portions extended from the second cam portion in a second direction and disposed parallel to each other; and a power unit to drive the shaft of the paper pickup unit.

25. The image forming apparatus according to claim 18, wherein the shock absorbing part elastically moves with respect to the guide cam when the guide part moves toward the guide cam to contact the shock absorbing part.

26. An image forming apparatus comprising:

a paper pickup unit including, a pressing plate at which a recording medium is stacked, a paper feed unit body to receive the pressing plate and having a guide part, a shaft rotatably mounted on a front end of the pressing plate, a pickup roller to rotatably engage the shaft to pick up the recording medium stacked on the pressing plate, and a guide cam installed at least one side of the shaft and having a shock absorbing part to engage the guide part installed at the paper feed unit body, the guide cam extended from the shaft in a first direction, and the shock absorbing part is extended in a second direction to move with respect to the guide cam to absorb a shock occurring when the guide part is in contact with the shock absorbing part; and a power unit to drive the shaft of the paper pickup unit.

27. The image forming apparatus according to claim 18, wherein the guide cam and the shock absorbing part are formed in a single monolithic body.

28. The image forming apparatus unit according to claim 18, wherein the guide cam and the shock absorbing part form a groove therebetween.

29. An image forming apparatus comprising:

a paper pickup unit including, a pressing plate at which a recording medium is stacked, a paper feed unit body to receive the pressing plate and having a guide part, a shaft rotatably mounted on a front end of the pressing plate, a pickup roller to rotatably engage the shaft to pick up the recording medium stacked on the pressing plate, and a guide cam installed at least one side of the shaft and having a shock absorbing part to engage the guide part installed at the paper feed unit body, the shock absorbing part having a distal end spaced apart from the shaft by a distance, and the distance varies according to a movement of the guide part toward the shaft while the guide cam and the shock absorbing part rotate with respect to a rotation axis of the shaft; and a power unit to drive the shaft of the paper pickup unit.

30. The image forming apparatus according to claim 18, wherein the paper feed unit body comprises an elastic element to generate a pressing force to move the pressing plate toward the paper pickup unit, and the shock absorbing part has an elastic force greater than the pressing force of the elastic element.

* * * * *